US006253466B1

(12) United States Patent
Harmon-Weiss et al.

(10) Patent No.: US 6,253,466 B1
(45) **Date of Patent: *Jul. 3, 2001**

(54) SHOE SLOE CUSHION

(75) Inventors: Edith Michele Harmon-Weiss, Swompscoll; David Arthur Mauceri, Methuen; Derek Alan Verhoorn, Stoneham, all of MA (US)

(73) Assignee: New Balance Athletic Shoe, Inc., Boston, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/317,410

(22) Filed: May 24, 1999

Related U.S. Application Data

(63) Continuation-in-part of application No. 08/985,999, filed on Dec. 5, 1997, now Pat. No. 6,026,593.

(51) Int. Cl.[7] ..... A43B 13/20
(52) U.S. Cl. ..... 36/28; 36/35 R; 36/37
(58) Field of Search ..... 36/28, 29, 37, 36/3 B, 71, 35 R, 88, 35 B

(56) References Cited

U.S. PATENT DOCUMENTS

| | | | |
|---|---|---|---|
| D. 297,980 | 10/1988 | Sugiyama | D2/314 |
| D. 300,085 | 3/1989 | Ito et al. | D2/318 |
| D. 349,186 | 8/1994 | Passke et al. | D2/961 |
| D. 387,547 | 12/1997 | Seydel et al. | D2/961 |
| 541,814 | 6/1895 | King . | |
| 896,075 | 8/1908 | Badgley . | |
| 900,867 | 10/1908 | Miller . | |
| 949,754 | 2/1910 | Busky . | |
| 1,011,460 | 12/1911 | Maddocks . | |
| 1,193,608 | 8/1916 | Poulson . | |
| 1,241,142 | 9/1917 | O'Hara . | |
| 1,382,831 | 6/1921 | Hilker . | |
| 2,028,060 | 1/1936 | Gilbert | 36/29 |
| 2,080,469 | 5/1937 | Gilbert | 36/29 |
| 2,106,788 | 2/1938 | Borman | 36/28 |
| 2,122,108 | 6/1938 | Modlin | 36/36 |
| 2,372,218 | 3/1945 | Manson et al. | 5/348 |

(List continued on next page.)

FOREIGN PATENT DOCUMENTS

| | | |
|---|---|---|
| 203631 | 10/1908 | (DE) . |
| 2800359 | 12/1979 | (DE) . |
| 3542960 | 6/1986 | (DE) . |
| 584489 | 2/1925 | (FR) . |
| 979132 | 4/1951 | (FR) . |
| 777630 | 6/1957 | (GB) . |
| 2032761 | 5/1980 | (GB) . |
| 1603646 | 11/1981 | (GB) . |
| 2225212 | 5/1990 | (GB) . |
| 92/04944 | 4/1992 | (WO) . |

*Primary Examiner*—M. D. Patterson
(74) *Attorney, Agent, or Firm*—Pennie & Edmonds LLP

(57) ABSTRACT

A shoe sole for supporting a wearer's foot. The sole has a main sole portion and at least one cushion associated with the main sole portion. The cushion includes first and second hollow tubular portions, preferably with resilient load-bearing first and second hollow walls that have a thickness, material, and shape providing sufficient strength for supporting and cushioning the sides of a corresponding foot region of a wearer's foot. The first wall is disposed on first side of a sole region of the sole, and the second wall is disposed on a second side of the sole region opposite from the first side. At least one of the first and second hollow walls extends along a third side of the sole region. A central portion of the cushion is disposed between and joined with the first and second tubular portions, and preferably has a thickness, material, and shape providing sufficient strength for supporting and cushioning a generally central part of the foot region between the first, second, and third sides.

26 Claims, 10 Drawing Sheets

U.S. PATENT DOCUMENTS

| | | | | |
|---|---|---|---|---|
| 2,393,577 | * | 1/1946 | Urbany | 36/29 |
| 2,405,498 | | 8/1946 | Gregg | 36/32 |
| 2,657,385 | | 11/1953 | Cushman et al. | 2/24 |
| 2,677,904 | | 5/1954 | Reed | 36/29 |
| 2,677,906 | | 5/1954 | Reed | 36/71 |
| 2,863,230 | | 12/1958 | Cortina | 36/29 |
| 3,041,746 | | 7/1962 | Rakus | 36/36 |
| 3,429,545 | | 2/1969 | Michel . | |
| 3,765,422 | | 10/1973 | Smith | 36/28 |
| 3,965,486 | | 6/1976 | Lightbody | 2/24 |
| 3,991,420 | | 11/1976 | Savarino | 2/2 |
| 4,054,960 | | 10/1977 | Pettit et al. | 5/357 |
| 4,063,371 | | 12/1977 | Batra | 36/3 |
| 4,115,885 | | 9/1978 | Davis | 5/349 |
| 4,137,653 | | 2/1979 | Famolare, Jr. | 36/3 B |
| 4,183,156 | | 1/1980 | Rudy | 36/44 |
| 4,217,705 | | 8/1980 | Donzis | 36/29 |
| 4,224,749 | | 9/1980 | Diaz-cano | 36/35 R |
| 4,229,889 | | 10/1980 | Petrosky | 36/28 |
| 4,267,648 | | 5/1981 | Weisz | 36/28 |
| 4,319,412 | | 3/1982 | Muller et al. | 36/29 |
| 4,342,158 | | 8/1982 | McMahon et al. | 36/35 |
| 4,458,429 | | 7/1984 | Schmid | 36/3 |
| 4,462,171 | | 7/1984 | Whispell | 36/3 |
| 4,471,538 | * | 9/1984 | Pomeranz et al. | 36/28 |
| 4,535,553 | | 8/1985 | Derderian et al. | 36/28 |
| 4,559,724 | | 12/1985 | Norton | 36/129 |
| 4,594,799 | | 6/1986 | Lin | 36/114 |
| 4,610,099 | | 9/1986 | Signori | 36/3 |
| 4,614,000 | | 9/1986 | Mayer | 5/484 |
| 4,629,433 | | 12/1986 | Magid | 441/40 |
| 4,670,995 | | 6/1987 | Huang | 36/29 |
| 4,680,875 | | 7/1987 | Danieli | 36/31 |
| 4,680,876 | | 7/1987 | Peng | 36/35 B |
| 4,741,114 | | 5/1988 | Stubblefield | 36/32 R |
| 4,753,021 | | 6/1988 | Cohen | 36/3 B |
| 4,768,295 | | 9/1988 | Ito | 36/28 |
| 4,774,774 | | 10/1988 | Allen, Jr. | 36/28 |
| 4,774,776 | | 10/1988 | Gulli | 36/29 |
| 4,815,221 | | 3/1989 | Diaz | 36/27 |
| 4,845,861 | | 7/1989 | Moumdjian | 36/29 |
| 4,878,300 | | 11/1989 | Bogaty | 36/35 |
| 4,887,367 | | 12/1989 | Mackness et al. | 36/28 |
| 4,912,861 | | 4/1990 | Huang | 36/29 |
| 4,918,838 | | 4/1990 | Chang | 36/28 |
| 4,918,841 | | 4/1990 | Turner et al. | 36/114 |
| 4,936,029 | | 6/1990 | Rudy | 36/29 |
| 4,972,611 | | 11/1990 | Swartz et al. | 36/28 |
| 4,999,931 | | 3/1991 | Vermeulen | 36/29 |
| 5,005,300 | | 4/1991 | Diaz et al. | 36/114 |
| 5,014,449 | | 5/1991 | Richard et al. | 36/114 |
| 5,067,255 | | 11/1991 | Hutcheson | 36/43 |
| 5,092,060 | | 3/1992 | Frachey et al. | 36/29 |
| 5,131,174 | | 7/1992 | Drew et al. | 36/29 |
| 5,174,049 | | 12/1992 | Flemming | 36/28 |
| 5,175,946 | * | 1/1993 | Tsai | 36/29 |
| 5,195,257 | * | 3/1993 | Holcomb et al. | 36/28 |
| 5,199,191 | | 4/1993 | Moumdjian | 36/28 |
| 5,212,878 | | 5/1993 | Burke et al. | 36/27 |
| 5,224,278 | | 7/1993 | Jeon | 36/29 |
| 5,245,766 | | 9/1993 | Warren | 36/29 |
| 5,253,435 | | 10/1993 | Auger et al. | 36/88 |
| 5,255,451 | | 10/1993 | Tong et al. | 36/30 |
| 5,257,470 | | 11/1993 | Auger et al. | 36/88 |
| 5,343,639 | | 9/1994 | Kilgore et al. | 36/29 |
| 5,353,459 | | 10/1994 | Potter et al. | 12/146 R |
| 5,353,523 | | 10/1994 | Kilgore et al. | 36/29 |
| 5,353,526 | | 10/1994 | Foley et al. | 36/92 |
| 5,367,792 | | 11/1994 | Richard et al. | 36/114 |
| 5,396,675 | | 3/1995 | Vincent et al. | 12/149 P |
| 5,406,719 | | 4/1995 | Potter | 36/28 |
| 5,416,988 | | 5/1995 | Potter et al. | 36/89 |
| 5,425,184 | | 6/1995 | Lyden et al. | 36/29 |
| 5,572,804 | | 11/1996 | Skaja et al. | 36/29 |
| 5,575,088 | | 11/1996 | Allen et al. | 36/28 |
| 5,625,964 | * | 5/1997 | Lyden et al. | 36/29 |
| 5,771,606 | | 6/1998 | Litchfield et al. | 36/29 |
| 5,787,609 | * | 8/1998 | Wu | 36/28 |
| 5,830,553 | * | 11/1998 | Huang | 36/29 |
| 5,842,291 | * | 12/1998 | Schmidt et al. | 36/28 |
| 6,026,593 | * | 2/2000 | Harmon-Weiss et al. | 36/28 |

* cited by examiner

SHOE SLOE CUSHION

This application is a continuation-in-part of application Ser. No. 08/985,999, filed Dec. 5, 1997, U.S. Pat. No. 6,026,593.

FIELD OF THE INVENTION

The present invention relates to a cushion for placement in a shoe sole for cushioning and supporting a foot. More particularly, the invention relates to a cushion that has U-shaped tubular portions disposed around a central portion for supporting a region of a foot.

BACKGROUND OF THE INVENTION

Resilient athletic shoe soles have been made with a variety of resilient cushioning elements for storing and absorbing impact energy imposed on a wearer's feet. Known shoe soles include fluid bladders that either contain pressurized air or a viscous liquid or gel to absorb shock and store energy.

U.S. Pat. No. 5,406,719, for instance, discloses a bladder that is pressurized with a gas. The bladder includes a heel support with various gas chambers. Gas chambers are located around the perimeter of the heel support, and additional chambers are located centrally in the heel support. The gas confined in the chambers provides cushioning for a foot as gas pressure increases in response to loads applied on the chambers. The patent shows the central chamber communicated with a lateral chamber so that internal gas pressure is equalized between the chambers.

U.S. Pat. No. 5,353,459 also shows a bladder for cushioning a heel. The bladder has a horse-shoe shaped chamber that extends about the periphery of the bladder, from the medial side to the lateral side around the rear of the bladder. Within the horse-shoe shape is a central chamber. As in the '719 patent disclosure, this stiffness of the chambers is controlled by altering the gas pressure therein.

U.S. Pat. No. 4,183,156 discloses an insole shaped insert with interconnected chambers that form pneumatic springs. Two of these chambers are tubular and extend around the sides and back of the heel of the insole. Two additional tubular chambers are disposed between the chambers that extend around the heel sides.

Cushioning bladders that employ a gas or other fluid to cushion shock to a foot suffer from a number of disadvantages. These bladders can usually leak over time, and gas units are especially prone to loss of pressure as the bladder ages. Moreover, the bladders are subject to punctures caused by sharp objects. Once the bladders are punctured, their contents are free to escape, and the bladders cease to effectively cushion shocks. Furthermore, fluid filled bladders also tend to pop and/or compress over time. Most perform significantly differently at different temperatures as the pressure or viscosity of the contained fluids varies. Also, because the fluid within the bladders tends to equalize the pressure within chambers of the bladders, compression of one part of a chamber may merely force the fluid to another part of the chamber decreasing control over localized deformation, and thus cushioning, of the bladder.

Other known soles employ resilient structures that rely on walls of the structure rather that on a fluid contained therein to cushion impact on a wearer's foot. U.S. Pat. No. 5,255,451, for example, teaches a shoe sole with an insert formed from a plurality of undulations. U.S. Pat. No. 4,774,774 shows a midsole formed of a honeycomb structure. Also, U.S. Pat. No. 4,342,158 teaches a sole with a coned disk spring member disposed in the sole heel.

SUMMARY OF THE INVENTION

The invention provides a cushion for use in a shoe sole. The cushion includes resilient load-bearing first and second hollow tubular walls that are shaped to support and cushion edges of the shoe wearer's foot. The tubular walls form first and second tubular portions, preferably extending along first and second portions of a boundary of a region of the sole. At least one of the tubular portions, but preferably both tubular portions, also extend on a third portion of the region to face each other, such that together, the tubular portions form a U-shape adjacent the edges of the region. The cushion is preferably disposed between a midsole and an outsole of the shoe sole.

The cushion also has a resilient load-bearing central wall configured to support and cushion a widthwise central part of the foot disposed generally centrally across the width of the foot shape. The central wall forms a hollow central portion and is located between and preferably joined with the tubular portions and is preferably of unitary construction with the tubular walls. The tubular portions are preferably vertically stiffer than the central portion to stabilize the supported region of the foot towards the central portion.

An embodiment of the cushion provides a coupled portion in which the central wall and first tubular wall are coupled such that vertical deformation of one of the central and first walls is transmitted to the other. The coupling portion can be placed in a heel strike area of the wearer's foot, which receives the first and concentrated loads generated during a running step.

At locations where the central and tubular walls are not coupled, the preferred embodiment has a recessed portion that joins the central portion and first tubular portion. Because this portion is recessed and preferably lacks walls that are vertically spaced to any significant extent, vertical deformation is substantially isolated between sections of the central wall and first tubular wall which are disposed adjacent the recessed portion.

As the support of the cushion is preferably provided by the load-bearing central and tubular walls themselves, any air trapped within the cushion is preferably not pressurized and is at atmospheric pressure. This reduces problems associated with fluid or gas pressurized bladders of the prior art.

In another embodiment, first and second hollow tubular portions respectively having resilient load-bearing first and second hollow walls. The cushion preferably has a weakened section between the first and second portions, preferably adjacent a bend section of at least one of the tubular portions that is bent around the boundary of the central portion. The weakened section has greater flexibility than the tubular portions and permits the cushion to flex about a line extending between the tubular portions.

The preferred placement in the sole of this embodiment is in a region corresponding to a region of the foot that includes at least one distal head of the metatarsals of the foot. Two cushions may be employed in a sole, for example adjacent and facing each other in regions of the sole that collectively define a larger sole distal metatarsal-head region including some or all of the distal metatarsal heads, most preferably at least the large distal metatarsal head. In this disposition, the first and second tubular portions of each cushion are most preferably generally aligned with the first and second tubular portion of the other cushion.

The cushion is disposed in this embodiment in a portion of the sole of increased flexibility. Grooves preferably extend generally widthwise in this more flexible portion, preferably adjacent the weakened section of the cushion, to increase fore and aft flexibility.

DETAILED DESCRIPTION OF THE PREFERRED EMBODIMENTS

Figure 1:
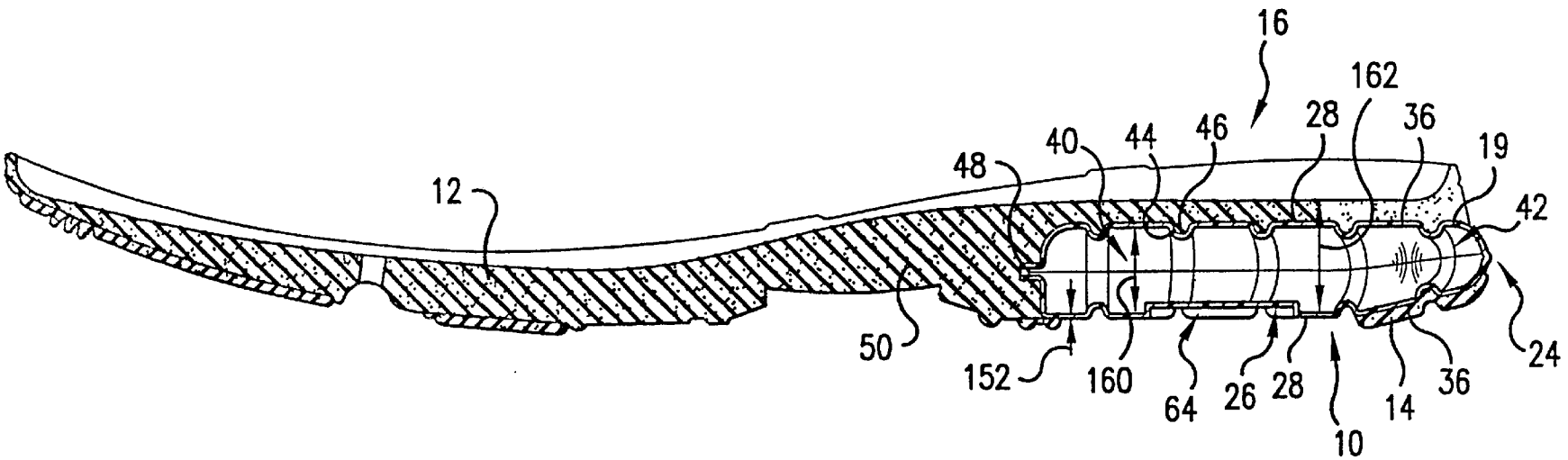
FIG. 1 is a cross-sectional lateral view of a portion of a left shoe sole with a cushion constructed according to the invention.

FIG. 1 shows a sole employing the preferred embodiment of a cushion 10 of the invention in a heel portion 16 of the sole. The sole includes a midsole 12 and an outsole 14. In this embodiment, the cushion 10 is part of the midsole 12, but is partially exposed on its lower side and may contact the ground, thus serving also as an outsole.

Figure 2:
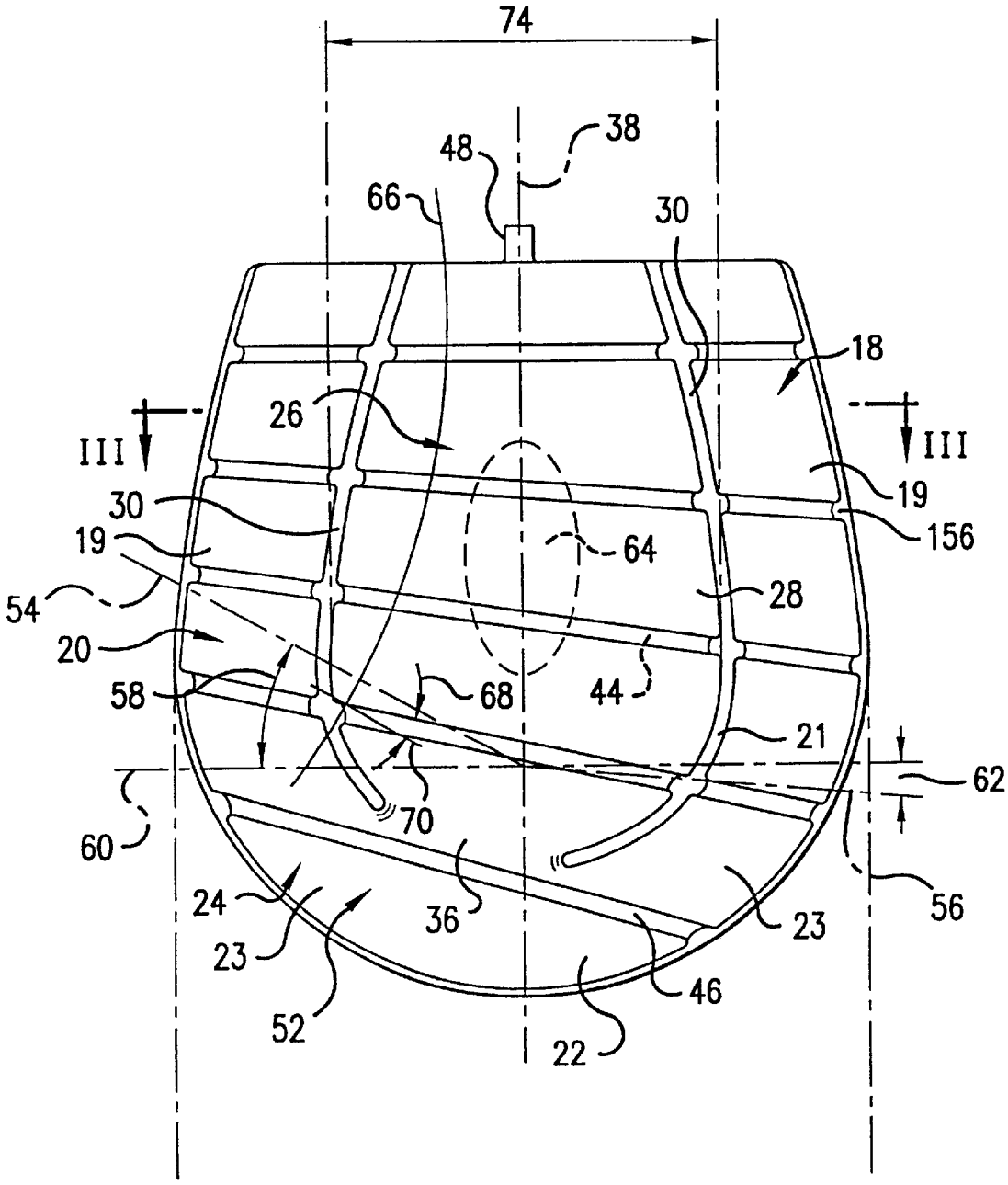
FIG. 2 is a top view of the cushion.

Referring to FIG. 2, the cushion has an outer tubular portion 24 that includes a medial tubular portion 18 and a lateral tubular portion 20, which are formed by resilient load-bearing tubular walls 19. Tubular portions 18 and 20 extend along medial and lateral edges of the foot shape of the sole. In the preferred embodiment, the tubular portions 18 and 20 extend generally along the medial and lateral edges of the heel shape part of the foot shape, in the heel region of the sole, opposite from each other with respect to the central portion 26. The tubular portions 18 and 20 also extend along the rear edge 22 of the heel shape, together preferably forming the single, substantially continuous, outer tubular-portion 24. The resulting tubular portion 24 extends in a U-shape substantially continuously along the contour of the heel shape. The walls 19 forming the outer portion 24 are preferably configured and dimensioned such that together with the main sole, the walls 19 support edges of a foot and cushion impact produced thereon, for example, by walking, running, or jumping, without collapsing.

Figure 3:
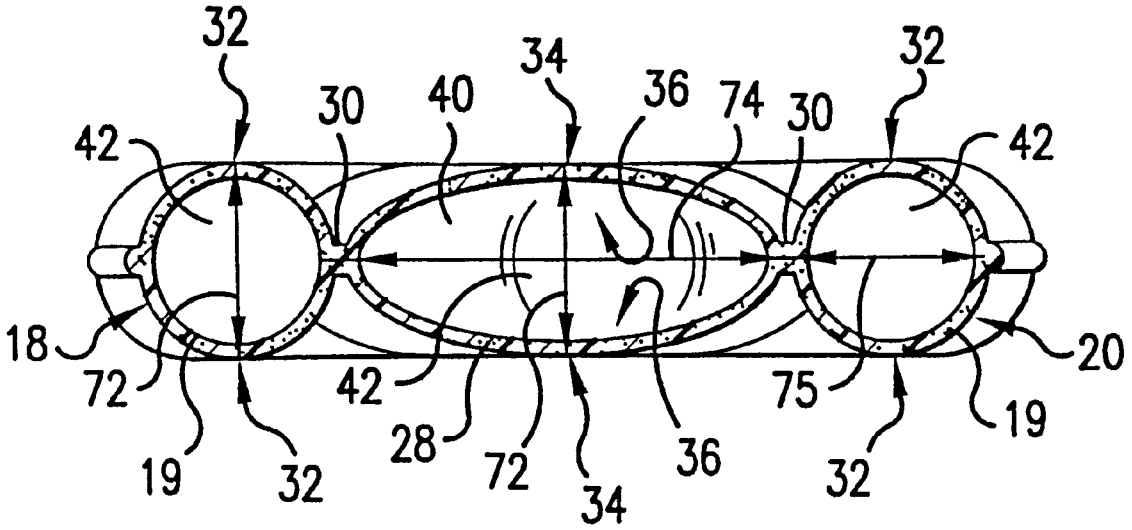
FIG. 3 is a cross-sectional front view of the cushion along plane III—III of FIG. 2.

A hollow central portion 26 is disposed between and joined with the medial and lateral portions 18 and 29. The central portion 26 is formed by a resilient load-bearing central wall 28, which, as shown in the embodiment of FIG. 3, includes upper and lower wall portions. Preferably, the central wall 28 is joined to the tubular walls 19 along a portion of its boundary 21, preferably along the entire extent at which the central portion 26 lies adjacent the tubular portion 24, including on the medial, lateral, and rear sides of the central portion 26, although the walls may be joined at less than the entire extent, or may be formed from separate pieces of material in alternative embodiments. Bend sections 23 of the tubular portions 18 and 20 are bent along the boundary 21 and have ends facing each other, which in this embodiment are connected. As seen in the embodiment of FIG. 2, bend sections 23 follow the shape of the boundary 21. The central wall 28 is preferably configured and dimensioned for supporting and cushioning a central portion of the foot, in this case of the heel region of the foot, together with the main sole portion, without collapsing.

The walls 28 and 19 themselves carry most of the loads imposed on the cushion 10. Hence, the air or other material contained within the cushion 10 is preferably not relied upon to support or cushion a foot. The walls 28 and 19 of the cushion provide a significant portion of the support by the cushion. Although air or other material may be trapped within the cushion, most preferably, the trapped material does not provide significant support or cushioning.

The cushion 10 also has recessed portions 30 that extend between the central and tubular portions 26 and 24. The recessed portions 30 join the central and tubular portions 26 and 24 while isolating vertical deformation between the sections of the tubular walls 19 and the central wall 28 that lie adjacent the recessed portions 30.

As seen in FIG. 3, the tubular walls 19 have vertically spaced elevated sections 32, and the central wall has vertically spaced elevated sections 34. The term elevated in this context includes upper and lower portions of the walls and does not refer solely to the top side of the cushion. Because the elevated portions 32 of the tubular walls 19 are isolated from the elevated portions 34 of the central wall 28, substantially no vertical compression is transmitted therebetween across the recessed portions 30.

Referring again to FIG. 2, the cushion 10 also includes a coupling portion 36 with at least one wall elevated from the level of the recessed portions 30, preferably separating recessed portions 30 of the cushion 10. The coupling wall 36 connects the central elevated sections 34 to the tubular elevated sections 32. This connection couples the adjacent elevated sections 32 and 34 such that vertical deformation is transmitted between the tubular walls 19 and the central wall 28.

The coupling portion 36 permits energy to be stored, absorbed, and returned to the foot by both the central walls 28 and the tubular walls 18 and 20 when the cushion 10 is impacted in locations on either the central or tubular portions 26, 18, or 20 that are near the coupling portion 36. The location of the coupling portion 36 is preferably selected to provide the improved cushioning near common areas of impact on the shoe sole. When the cushion is disposed in the heel of a sole, the coupling portion 36 is preferably disposed at the rear of the heel, generally aligned with a heel strike area 52, which is known in the art, as explained below.

Figure 4:
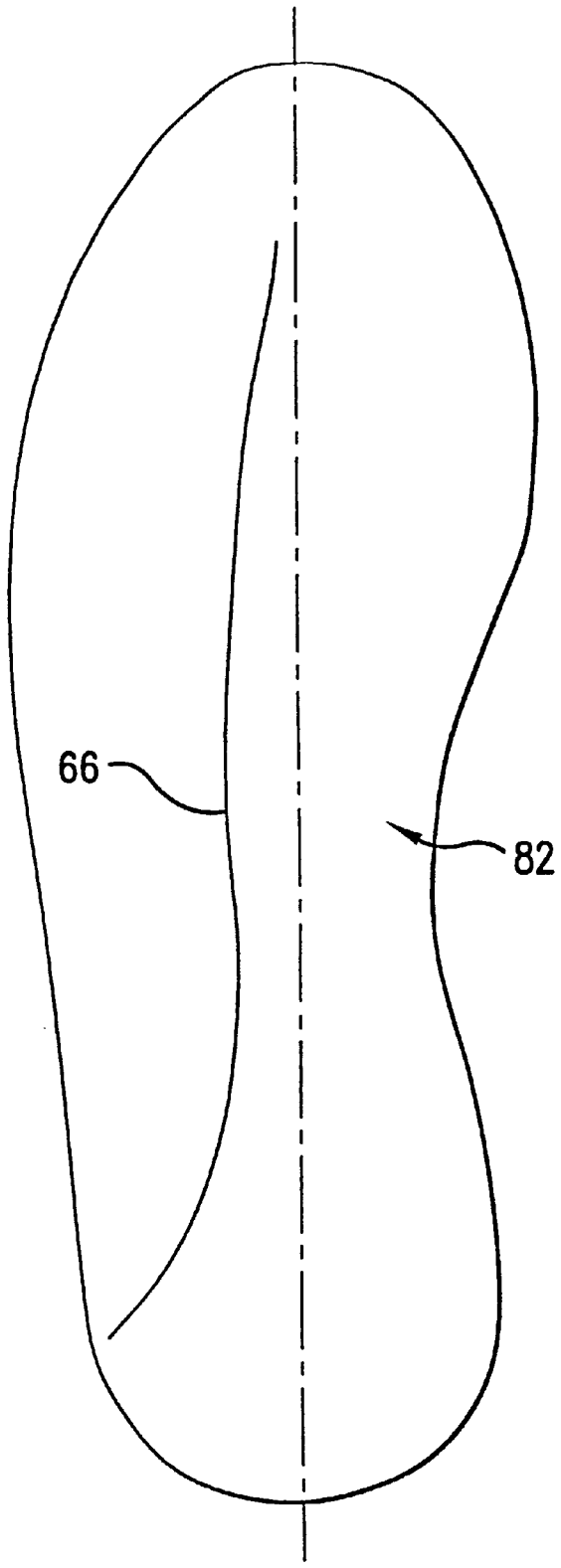
FIG. 4 is a top view of a running strike-path on a foot shape.

It is well known in the art that during a step, particularly while a wearer is running, the wearer's foot strikes the sole generally along a strike path 66, shown in FIG. 4. The strike path 66 along the sole is S-shaped and extends from the heel to the fore foot portion of the foot shape 82 of the sole. This path 66 receives first and largest loads from impact on the sole. The heel strike area 52 is the area in the heel of the sole that is known to receive the first and most intense impact by a wearer's foot.

The cushion is shown in FIG. 2 disposed in the sole such that the heel strike area 52 is disposed in the region defined behind lines 54 and 56. In the preferred cushion 10 sized for a men's size 9.5 shoe, lines 54 and 56 intersect centerline 38 of the cushion 10 at about 23 to 31 mm from the rear of the cushion 10. This distance varies according to shoe size. Line 54 extends laterally at an angle 58 of about 25° forward from a horizontal line 60 normal to the centerline 38. Preferably angle 58 is generally 12° and 36°, such as between about 20° and 30°, and most preferably, angle 58 is about 25.5°. Line 56 extends medially at an angle 62 of about 5° behind line 60. Preferably angle 62 is between about 0° and 25°, such as between 1° and 10°, and most preferably, angle 62 is about 4.5°. Thus, the coupling portion 36, being disposed generally centrally with respect to the heel strike area 52, is displaced laterally from the centerline 38.

Because central and tubular portions 26 and 24 are hollow, the central portion 26 defines a central interior chamber 40, and the tubular portion 24 defines a tubular interior chamber 42. Central interior chamber 40 extends substantially across the middle of the cushion. The central and tubular chambers 40 and 42 are communicated through the interior of the coupling portion 36. In the preferred embodiment, the tubular and central walls 19 and 28 are coupled for transmitting vertical deformation therebetween where the coupling portion 36 communicates the interior chambers 40 and 42. In an alternative embodiment, however, these chambers 40 and 42 may be separated internally if desired. Also, in another alternative embodiment, the hollow central and tubular walls 28 and 19 may be filled with a deformable filler material such as a foam, gel, or other material commonly employed in shoe soles.

The central and tubular walls 28 and 19 also preferably comprise stiffening ribs 44 that extend widthwise across the central and tubular portions 26 and 24. It should be appreciated that FIG. 3 omits the ribs 44 for clarity. As the walls 19 and 28 of the cushion 10 of the embodiment shown are of substantially uniform thickness, the ribs 44 form grooves 46 on an opposite side of the walls 19 and 28 therefrom. Ribs 44 increase the bending stiffness of the walls 19 and 28. The walls 19 and 28 become stiffer as the ribs 44 are spaced closer to each other, made thicker, and as they extend further from the remainder of the surface of the walls 19 and 28. The ribs 44 are preferably between about 1–4 mm wide and are spaced by between about 6–18 mm.

Although the ribs may be oriented in parallel to each other, the preferred ribs extend in an orientation generally perpendicular to the running strike path 66 shown in FIG. 4. The ribs 44 of the embodiment shown are oriented at an angle 68 of preferably less than about 40° from a line 70 normal to the strike path 66, and more preferably of less than about 20° therefrom.

As shown in FIG. 1, the bottom central wall 28 preferably includes an indented portion 64 that has substantially the same depth as the ribs 44. Thus, the ribs 44 do not extend across this indented portion 64. In another embodiment, additional outsole material may be fixed to the indented portion 64, or the indented portion 64 may display decorative or trade insignia. FIG. 2 shows the indented portion 64 as having a generally elliptical shape. A further embodiment does not have an indented logo portion, but instead has a logo formed by a raised surface of the central wall.

The preferred cross-sectional shape of the cushion 10 taken along plane III—III of FIG. 2, which that extends widthwise and vertically through the cushion 10, is best shown in FIG. 3. Both the central and tubular walls 28 and 19 have an arcuate shape. The central wall 28 preferably defines an oval, and most preferably an elliptical cross-section, although other shapes, such as with angled corners are suitable. The oval shape can be circular, elliptical, or other elongated shape with generally rounded ends, which may also be formed a plurality of linear segments that form the generally rounded ends.

The preferred cross-sections of the tubular walls 19 are generally circular when compared to the cross-section of the central wall 28. Due to these shapes, the cushion 10 stores and returns energy to a wearer. The relatively wide and horizontal elevated portions 34 of the central walls 28 renders the central portion less stiff than the tubular portion 24. At the widest part of the cushion 10, which is shaped for a heel, the central portion 26 reaches a maximum width 74 that is preferably greater than about 50% of the maximum width 84 of the cushion 10 from the medial edge of the medial tubular portion 18 to the lateral edge of the lateral tubular portion 20, and more preferably about 60% as wide as the maximum width 84 of the cushion 10. Preferably, one of the medial and lateral tubular portions 18 and 20 is at least about 15% as wide as the central portion 26 where the cushion 10 is widest, and more preferably about 20% as wide.

Also, in the preferred embodiment, the central and tubular portions 26 and 24 have substantially the same vertical height 72. An aspect ratio of each cushion portion 18 and 20 is defined as the ratio of the widths 74 and 75 of the cushion portions 24 and 26 to the height 72 thereof. The aspect ratios of the tubular portions 18 and 20 are measured across their central axes. The maximum aspect ratio of the central portion 26 is between about 2 and 3, and preferably about 2.6. The aspect ratio of the tubular portion 24 is between about 0.75 and 1.5 along the lateral and medial sides of the cushion 10, and is preferably about 1.

The resulting higher stiffness of the tubular portion 24 when compared to the central portion 26 is desired as this stabilizes a foot toward the central portion 26 during impact. With the central walls 28 deforming vertically more than the tubular walls 19 during an impact, the cushion 10 directs the foot towards the central portion 26 during each stride, reducing the chance of injury.

Figure 5:
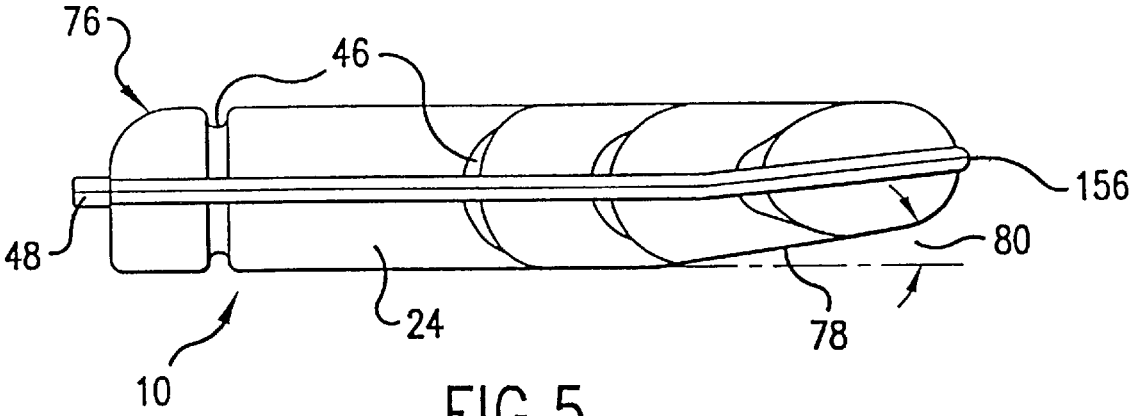
FIG. 5 is a lateral view of the cushion.

Referring to FIG. 5, the forward part of the cushion 10, including the central and tubular walls 28 and 19, has a rounded forward edge 76. Rounded edge 76 facilitates flexure of the longitudinally central part of the sole during a step. Also, the rear of the cushion 10 becomes vertically thinner as a lower rear surface 78 is angled upwardly at an angle 80 of about 10° from the horizontal. This angle 80 provides a raised heel of the outsole to improve comfort while a wearer is running.

Figure 6:
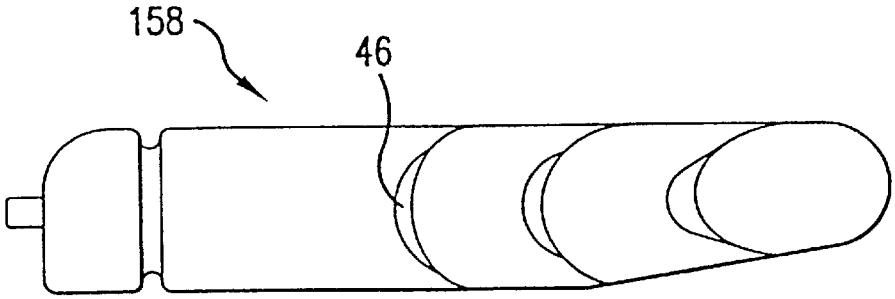
FIG. 6 is a lateral view of another embodiment of the cushion.

The cushion 10 of FIG. 5 has a rim 156 formed around the horizontal outer border of the tubular walls. The cushion 158 of FIG. 6, on the other hand, does not have a rim, and the grooves 46 extend completely around the outer part of the tubular portions.

The cushion 10 is preferably blow molded as a single piece of unitary construction. HYTREL HTR5612 or HTX8382, polyester elastomers designed for blow molding and sold by Dupont, are preferred materials for use in the construction of the cushion 10. Other materials very suitable for blow molding the cushion 10 have relatively high melt viscosities. The most preferred cushion material preferably has a Poisson's ratio of about 0.45, a flexural modulus of around 124 MPa, and a hardness durometer of 50 on the D scale. When subjected to a compression test in which the material is compressed to 50% of its original thickness for 48 hours and then released, the material preferably decompresses substantially completely. The preferred HYTREL material returns to within 1% of its original thickness after a compression test. The remainder of the midsole, outsole, and insole, which is mounted above the midsole for placement adjacent a foot, are made from conventional materials. The main sole portion 50 preferably has an EVA main sole 12, which is ethyl vinyl acetate, and an outsole 14 made from blown rubber, clear rubber, and solid rubber.

With the preferred materials, the preferred thickness 152 of the walls of the heel cushion is between about 1.4 mm to 2.4 mm to support and cushion the heel together with the remainder of the sole without collapsing. This thickness can be decreased or increased depending on the activity for which the shoe is built. The thickness may also be varied in a single cushion to localize variations in stiffness. The preferred height 160 of the cushion is between about 60% and 95% of the height 162 of the sole at the cushion, and most preferably between about 80% and 85%.

As a result of the blow molding process, a hollow stub 48 remains through which air was blown during manufacturing. This stub 48 is preferably sealed to prevent the cushion 10 from emitting an annoying noise each time a step is taken, as air is sucked in and blown out through the stub. Sealing the stub 48 also prevents water, or other fluids that may be present on a walking surface from entering the cushion 10. If the stub 48 itself is not closed, adjacent material of the main sole portion 50 of the shoe sole may be used to close the stub opening. As mentioned above, although the cushion 10 traps air once the stub 48 is closed, the walls 19 and 28 of the cushion 10 provide the main support and cushioning for a foot, instead of the trapped air. Trapped air, if any, is preferably not significantly pressurized.

Figure 7:
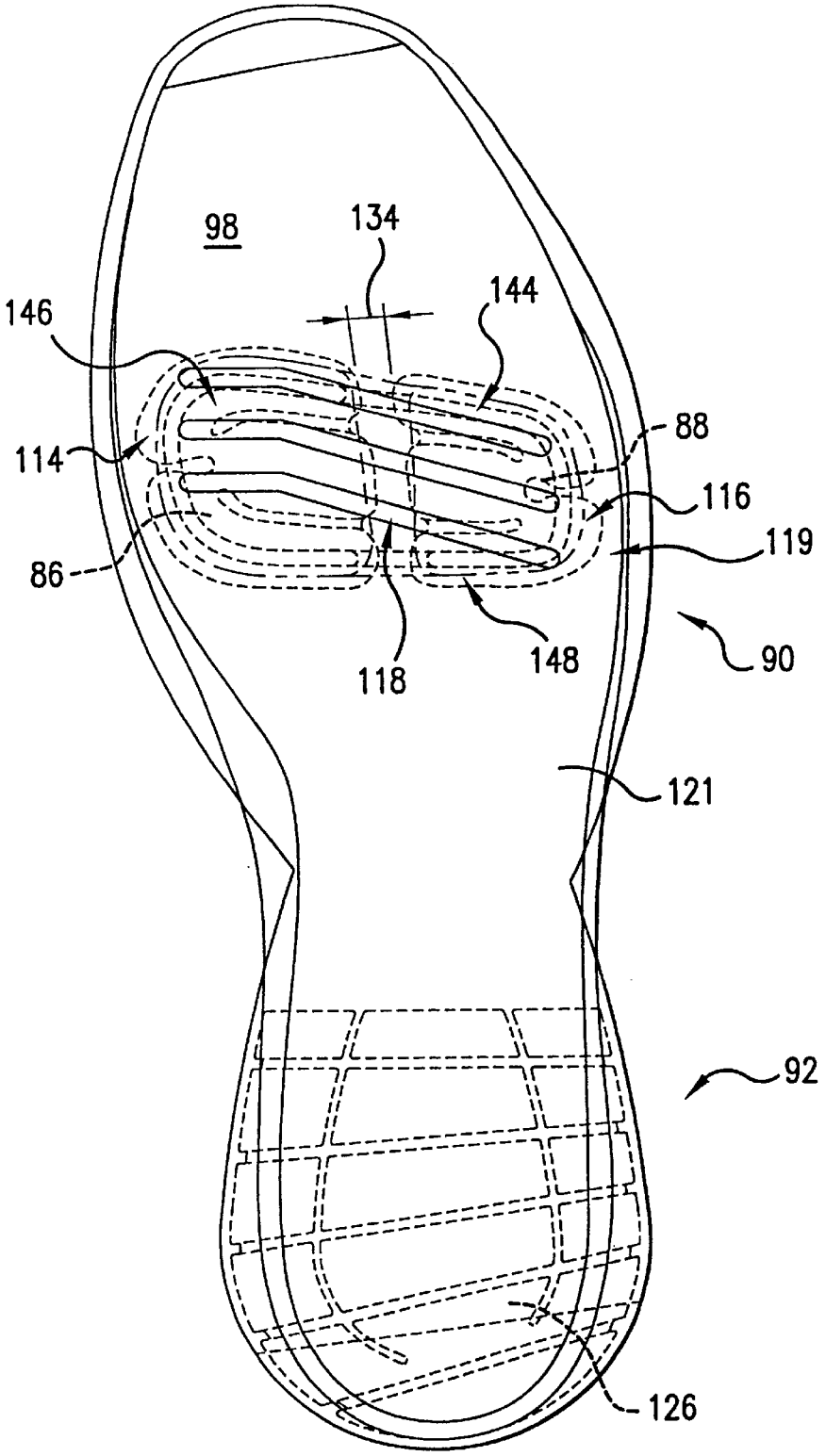
FIG. 7 is a top view of another embodiment of a sole constructed according to the invention.
Figure 8:
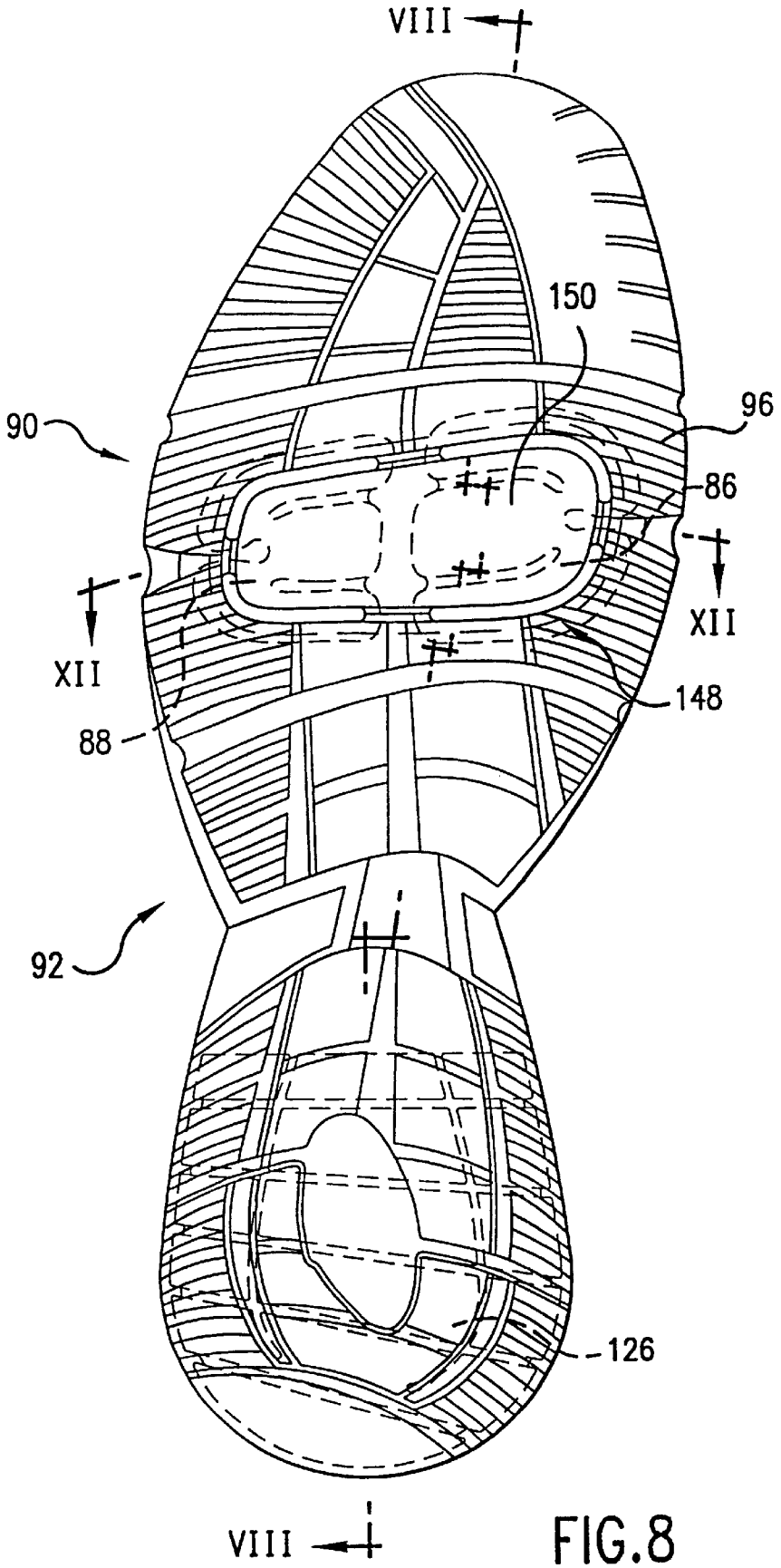
FIG. 8 is a bottom view thereof.
Figure 9:
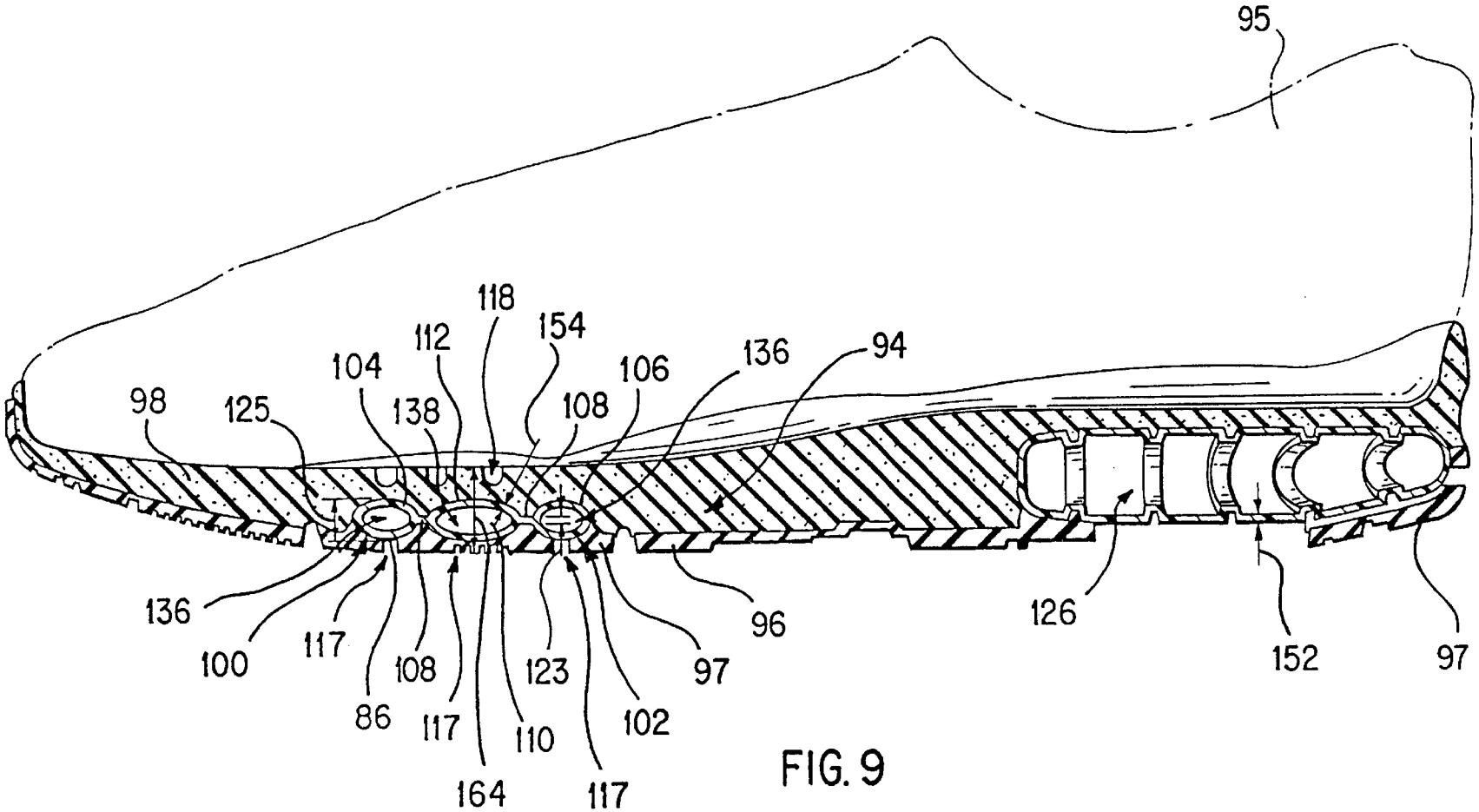
FIG. 9 is a cross-sectional view of the sole along line VIII—VIII of FIG. 8.

Referring to FIGS. 7–9, a right foot sole of another embodiment of the invention is shown, including a medial and a lateral forefoot cushion 86 and 88 disposed in a forefoot region 90 of sole 92. The forefoot cushions 86 and 88 are disposed in a main sole portion 94, which includes an outsole 96, including strike pads 97 and being disposed beneath the forefoot cushions 86 and 88, and also includes a midsole layer 98. The midsole layer may consist of one or more layers, preferably of a foam rubber. The forefoot cushions 86 and 88 may also be positioned at different depths in the main sole portion 94, such as completely within the midsole layer 98 or beneath the outsole 96, but is most preferably disposed beneath the midsole layer and also adjacent the outsole 96. The preferred thickness 154 of the forefoot cushion walls is from about 1–2 mm, as in the previous embodiment, to prevent collapsing during a running stride or other impact for which the shoe is constructed. As with the heel portion of the sole, without the cushions in the sole, the cavities in which the cushions would otherwise be disposed would preferably collapse under the impact of a stride, although in an alternative embodiment, the midsole material is stiff enough to prevent collapse of the cavities if the cushions were not in place. The preferred height 125 of the forefoot cushions is between about 30% and 80% of the height 164 of the main sole portion at the cushions, and most preferably between about 40 and 50%.

Figure 10:
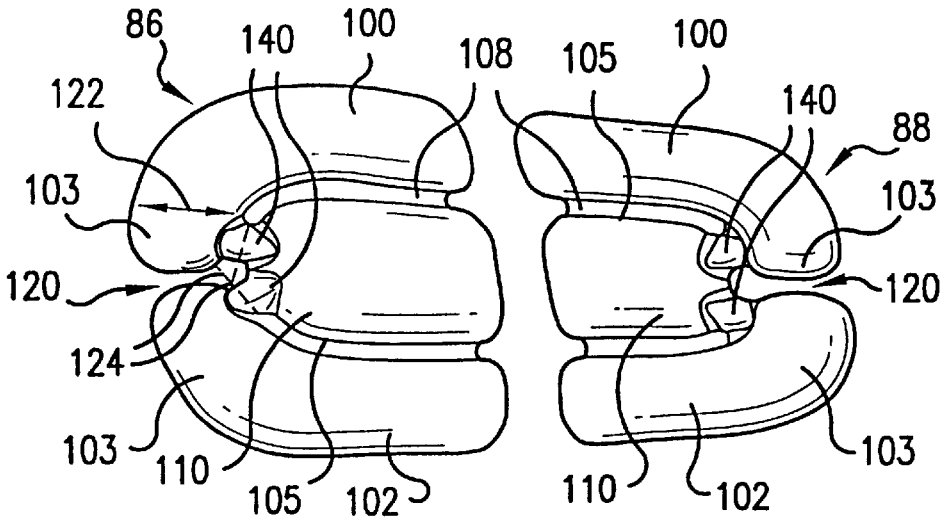
FIGS. 10–12 are top, back, an medial side views of forefoot cushions of the sole.
Figure 11:
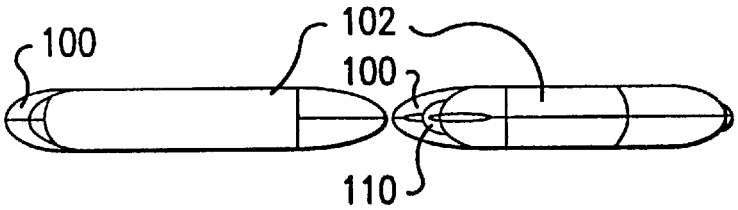
Figure 12:
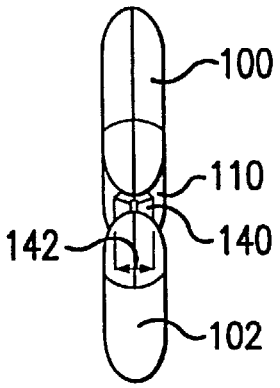
Figure 13:
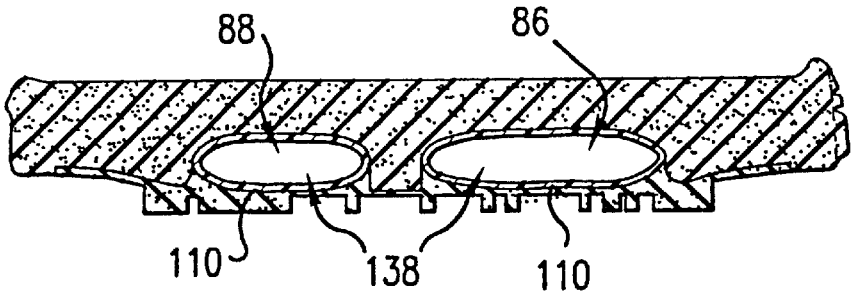
FIG. 13 is a cross-sectional view along line XII—XII of FIG. 7.

As shown in FIGS. 10–12, the forefoot cushions 86 and 88 are preferably each a single piece of unitary construction with front and back hollow, elongated tubular-portions 100 and 102. The tubular portions 100 and 102 preferably have resilient load-bearing walls 104 and 106, best shown in FIG. 9, of an oval cross-sections along a plane that extends generally lengthwise or longitudinally through the shoe and sole. Webs 108, defining recessed portions, join the tubular portions 100 and 102 to a central portion 110 disposed therebetween, which is also of an oval cross-section along a plane extending generally longitudinally through the sole 94. The tubular portions 100 and 102 extend on opposite sides of the central portion 110. The wall 112 of the central portion 110 is preferably also resilient and load bearing. Also, the blow molding stub 48 shown in the embodiment of FIGS. 1–5 is preferably severed and closed in the forefoot and heel cushions 86, 88, and 126 of the embodiments of FIGS. 7–13, although stubs may also be present in alternative embodiments.

The cushions 86 and 88 are shown disposed in referred regions 144 and 146, together defining a larger region 148, of the sole are at least one metatarsal region of the sole, corresponding to and located beneath a region of the wearer's foot with the foot properly positioned on the sole 94 and held in place by the sole 94 and upper 95, which is attached to the sole 94. The preferred foot region includes the distal heads of the metatarsals. The walls 104, 106, and 112 preferably have a thickness, material, and shape providing sufficient strength for supporting and cushioning, together with the main sole portion, the sides, in the case of the tubular walls 104 and 106, and a central part, in the case of the central wall 112, of the foot below which the forefoot cushions 86 and 88 are located. The cushion in this embodiment, however, may alternatively have more pliant walls that are strong enough in tension to contain a fluid, such as a liquid, a gel, or a gas, to provide the necessary cushioning, although the load bearing walls described are preferred. The front tubular portions 100 are thus preferably disposed beneath the phalanges of the foot.

At least one, and preferably both, of the tubular portions 100 and 102 have a bend section 103 that is bent around the boundary 105 of the central portion 110 towards the other of the tubular portions 100 and 102, thus extending along a third side of the regions 144 and 146 of the sole. Although sides of the regions are mentioned, the regions may be round in other embodiments, but alternatively may have angular edges between the sides. The tubular portions 100 and 102 preferably define at least a U-shape and most preferably have generally constant heights, or heights that vary in a generally linear fashion, preferably varying less than about 80% along their length, although other tubular shapes are also suitable, such as tubular portions with wave longitudinal cross-sections. In other embodiments, the heights and widths may vary to a greater degree, but a smooth elongated outer surface of the tubular portions 100 and 102 is preferred. In the medial cushion 86, the third side is most preferably the medial side 114 of the distal metatarsal head region. In the lateral cushion 88, the third side is most preferably the lateral side 116 of the distal metatarsal head region. Most preferably, both front and back tubular portions 100 and 102 extend along at least part of the third side. The central portion 110 of the medial cushion 86 is preferably disposed beneath the distal head of the large metatarsal, at the ball of the foot, to cushion this part of the foot during a stride, including storing and returning energy to the foot.

Together, the lateral and medial cushions 86 and 88 are disposed in a larger sole region 148, which as described above, is preferably below all of the distal metatarsal heads. The third sides 114 and 116 are disposed on the medial and lateral sides of the larger region 148, on opposite sides of the larger region 148 from each other. The larger region 148 is longer in a longitudinal, fore and aft, direction near the medial side 114 than near the lateral side. Preferably the medial side is between 40% and 70% longer, and more preferably about 50% longer. As a result, the medial cushion 86 is preferably larger than the lateral cushion 88, better accommodating the large distal metatarsal head on the medial cushion 86. The front and back sides of the regions 144 and 146 are located on the front and back sides of the larger region 148. The front and back tubular portions 100 and 102 of the medial forefoot cushion 86 are generally aligned with the front and back tubular portions 100 and 102 of the lateral forefoot cushion 88. The tubes have axes preferably oriented at less than about 50° from the medial/lateral direction of the sole 94.

The tubular portions 100 and 102 of the preferred embodiments are vertically stiffer than the central portion 110, preferably by providing the tubular walls 104 and 106 with a shape having increased vertical stiffness. Thus, like the walls of the heel cushion 10, the tubular walls 104 and 106 preferably have a greater curvature than the central wall 112 or have a lower cross-sectional aspect ratio, although the aspect ratios of the tubular portions 100 and 102 of the forefoot cushions 86 and 88 are preferably higher than the aspect ratios of the tubular portions 18 and 19 of the heel cushion 126, resulting in a flatter shape. Consequently, a distal metatarsal head impacting above one of the forefoot cushions 86 or 88 is stabilized towards the central portion 110 and maintained within the proper region of the sole 94.

Transverse grooves 118 extend across the sole 94 in a medial/lateral direction above the forefoot cushions 86 and 88 in the main sole portion 98. Also, grooves 117 are defined through the outsole 96, extending transversely underneath the forefoot cushions 86 and 88. These grooves 117 and 118 increase the fore and aft flexibility of the sole 94 in the larger sole region 148, defining an increased flexibility portion 119 of the sole 94, and a decreased flexibility portion 121 thereof. The outsole grooves 117 of the preferred embodiment join a recessed area 150 at the bottom of the outsole 96, which also increases the local flexibility.

Also to increase the flexibility out of the horizontal plane in which the cushions 86 and 88 are located, in a vertical direction, each forefoot cushion 86 and 88 has a weakened section 120 on the third side, preferably between the front and back tubular portions 100 and 102. The tubular portions 100 and 102 are preferably spaced from each other at the weakened section 120 and are not connected by any member of integral construction with the cushions 86 and 88, but may be attached by a web or a member of substantially smaller height or thickness with greater flexibility than the tubular portions, preferably less than half of the height. The weakened section may also be formed by making a slit through a continuous U-shaped tubular portion as the one shown in the embodiment of FIGS. 1–5. The slit would thus divide the front and back tubular portions. The weakened section may also comprise a narrow tubular portion connecting the tubular portions.

The web 108 between the tubular portions 100 and 102 and the central portion 110 has a substantially smaller height 123 than the height 125 of the tubular and central portions 100, 102, and 110, as shown in FIG. 9. In the preferred embodiment, the weakened section 120 extends across substantially the entire width 122 of the tubular portions 100 and 102 to cross the extended centerline 124 of the groove 108, facilitating the flexing of the cushions 86 and 88 about the weakened portion 120 and the grooves. This structure improves the bendability of the sole 94 about the distal heads of the metatarsals as the toes of the foot bend upwardly during walking or running.

The tubular portions 100 and 102 and the central portion 110 are hollow and enclose chambers 136 and 138. Chambers 136 and 138 are fluidly communicated by tubes 140 to facilitate the blow molding of the forefoot cushions 86 and 88. The height 142 of the tubes 140 is preferably substantially less than the height 125 of the tubular and central portions 100, 102, and 110, maintaining the flexibility of the forefoot cushions 86 and 88 across the tubes 140 from the weakened section 120 through the webs 108. Another embodiment does not have tubes 140.

Figure 14:
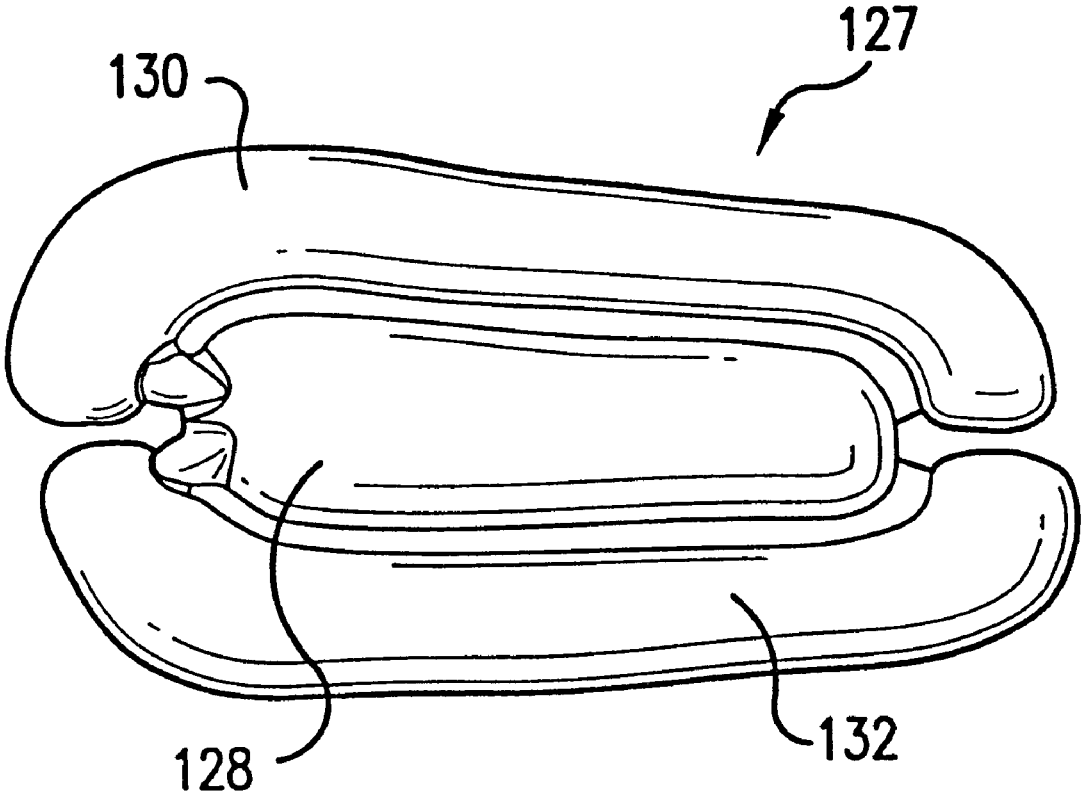
FIG. 14 is a top view of another embodiment of a forefoot cushion constructed according to the invention.

The two forefoot cushions may be constructed together as a single piece, joined by a web or with the corresponding tubular and central portions 100, 102, and 110 formed in continuation of each other, as the single cushion 127 shown in FIG. 14. Single cushion 127 has a central portion 128 and front and back tubular portions 130 and 132 and occupies substantially the entire larger region 148 of the sole by itself. The cushions 86 and 88 of the embodiment of FIG. 10, however, are two separate pieces. This permits a manufacturer to use a single size of forefoot cushions 86 and 88 in a range of shoe and sole sizes, by spacing the forefoot cushions 86 and 88 by a smaller distance 134 in smaller sole sizes, and by a larger distance 134 in larger sole sizes.

One of ordinary skill in the art can envision numerous variations and modifications. For example, the tubular portions of an alternative embodiment may be constructed as a separate piece from the central portions, and held in place by the midsole, or may be placed in different regions of the sole or in other orientations in the horizontal or other plane. In addition, the shapes, dimensions, locations, and stiffnesses of the cushions and part thereof can be varied in shoes built for activities other than running, such as tennis, basketball, cross training, walking. The forefoot cushions in a basketball shoe, for example, may be harder with respect to the heel cushion than is a walking shoe, due to increased forefoot impact in basketball. The two forefoot cushions in a shoe may also have different stiffnesses compared to each other; for instance the lateral forefoot cushion may be stiffer than the medial forefoot cushion. All of these modifications are contemplated by the true spirit and scope of the following claims.

What is claimed:

1. A cushion for use in a shoe sole, the cushion comprising:

a central portion having a resilient load-bearing hollow central wall comprising a thickness, material, central portion boundary, and shape providing sufficient strength for cushioning a region of the sole; and first and second tubular portions having resilient load-bearing first and second hollow tubular walls with a thickness, material, and shape providing sufficient strength for cushioning at least part of a boundary of the region of the sole, the first portion disposed along a first part of the central portion boundary, and the second portion being disposed along a second part of the central portion boundary opposite from the first portion, wherein the first portion has a first bend section that is bent along the central portion boundary to resist flexing across the first bend section.

2. The cushion of claim 1, wherein the second portion has a second bend section that is bent along the boundary of the central portion facing the first bend section to resist flexing across the second bend section.

3. The cushion of claim 1, further comprising a weakened section between the first bend section and the second tubular portion, the weakened section facilitating flexing of the cushion thereacross.

4. The cushion of claim 3, wherein the first bend section and the second tubular portion are spaced from each other at the weakened section.

5. The cushion of claim 1, wherein at least one of the first and second tubular portions includes another bend section bent around the boundary of the central portion substantially opposite from the first bend section with respect to the central portion.

6. The cushion of claim 1, wherein the tubular portions are vertically stiffer than the central portion for stabilizing a portion of a wearer's foot towards the central portion when supported on the cushion.

7. The cushion of claim 1, wherein the tubular walls and the central wall are a single piece of unitary construction.

8. The cushion of claim 1, wherein the cushion includes a web having a smaller height than the tubular and central portions and connecting the tubular portions to the central portion.

9. The cushion of claim 1, wherein the tubular and central portions are configured and dimensioned for cushioning a region of the sole that includes at least one distal metatarsal head region.

10. The cushion of claim 1, wherein the tubular and central walls have a connection configured for substantially isolating vertical compression of one of the tubular portions from vertical compression of the other portions when the cushion is subjected to forces during a user's stride.

11. The cushion of claim 10, further comprising a recessed portion disposed along the central portion boundary, wherein the first and second walls comprise first and second elevated sections, respectively, and the central wall comprises a central elevated section, which is substantially isolated from the first and second elevated sections by the recessed portion to substantially isolate vertical compression of the tubular walls from the central wall.

12. The cushion of claim 1, wherein the central wall comprises upper and lower wall portions defining a hollow chamber therebetween that extends substantially across the middle of the cushion.

13. The cushion of claim 1, wherein the central and first and second tubular portions are substantially arcuate.

14. The cushion of claim 1, wherein the bend section is bent along the central portion boundary generally following the shape thereof.

15. The cushion of claim 1, further comprising a shoe sole that has a sole height, wherein the cushion is operably associated with the shoe sole, and has a cushion height that is between about 60% and 95% of the sole height at the cushion.

16. A shoe sole for supporting a wearer's foot, the sole comprising:

a main sole portion; and at least one cushion associated with the main sole portion and including:

a central portion disposed in a region of the sole and having a resilient load-bearing hollow central wall comprising a thickness, material, central portion boundary, and shape providing sufficient strength for cushioning the region of the sole; and first and second tubular portions having resilient load-bearing first and second hollow tubular walls with a thickness, material, and shape providing sufficient strength for cushioning at least part of the boundary of the region of the sole, the first portion being disposed along a first part of the central portion boundary, and the second portion being disposed along a second part of the central portion boundary opposite from the first portion, wherein the first portion has a first bend section that is bent along the central portion boundary to resist flexing across the bend section.

17. The sole of claim 16, wherein the sole region includes a distal metatarsal head region of the sole.

18. The sole of claim 16, wherein the main sole portion includes an increased flexibility portion and a decreased flexibility portion that is less flexible than the increased flexibility portion, the cushion being disposed in the increased flexibility portion.

19. The sole of claim 18, wherein the increased flexibility portion defines grooves extending generally widthwise increasing fore and aft flexibility of the increased flexibility portion.

20. The sole of claim 18, wherein the cushion has a weakened section between the tubular portions on the third side having greater flexibility than the tubular portions and permitting the cushion to flex along a line extending between the tubular portions, the weakened section being disposed adjacent the grooves.

21. The sole of claim 16, wherein:

the at least one cushion includes first and second cushions;

the sole region comprises first and second sole regions adjacent each other and collectively defining a larger sole region; and the first bend sections of the cushions are disposed opposite from each other with respect to the larger sole region.

22. The sole of claim 21, wherein the first and second tubular portions of each cushion are generally aligned with the first and second tubular portion of the other cushion, respectively.

23. The sole of claim 21, wherein the larger sole region is a collective distal metatarsal head region of the sole includes all distal metatarsal head regions of the sole.

24. The sole of claim 16, wherein the cushion has a weakened section between the first bend section and second wall portion having greater flexibility than the tubular portions permitting the cushion to flex about a line extending between the tubular portions.

25. The sole of claim 16, wherein:

the main sole includes a midsole layer and an outsole; and the cushion is disposed between the midsole layer and the outsole.

26. A cushion for use in a shoe sole, the cushion comprising:

a resilient load-bearing central portion having a central portion boundary, the central portion being resilient and load bearing for cushioning a region of the sole;

first and second tubular portions having resilient load-bearing first and second hollow tubular walls with a thickness, material, and shape providing sufficient strength for cushioning at least part of a boundary of the region of the sole, the first portion disposed along a first part of the central portion boundary, and the second portion disposed along a second part of the central portion boundary opposite from the first portion, wherein the first portion has a first bend section that is bent along the central portion boundary to resist flexing across the first bend section; and wherein the tubular portions are vertically stiffer than the central portion for stabilizing a portion of a wearer's foot towards the central portion when supported on the cushion.

* * * * *

UNITED STATES PATENT AND TRADEMARK OFFICE

CERTIFICATE OF CORRECTION

PATENT NO. : 6,253,466 B1
DATED : July 3, 2001
INVENTOR(S) : Harmon-Weiss et al.

It is certified that error appears in the above-identified patent and that said Letters Patent is hereby corrected as shown below:

Title page,
Item [54], change the title "SHOE SLOE CUSHION" to -- SHOE SOLE CUSHION --.

Item [75], line 2, change the city "Swompcoll" to -- Swampcott".

Signed and Sealed this

First Day of January, 2002

*Attest:*

*Attesting Officer*

JAMES E. ROGAN
*Director of the United States Patent and Trademark Office*